United States Patent [19]

Maxson

[11] 4,245,380

[45] Jan. 20, 1981

[54] MULTIPLE HEAT PIPE HEAT EXCHANGER AND METHOD FOR MAKING

[75] Inventor: Dale E. Maxson, Rockford, Ill.

[73] Assignee: Barber-Colman Company, Rockford, Ill.

[21] Appl. No.: 956,548

[22] Filed: Nov. 1, 1978

Related U.S. Application Data

[62] Division of Ser. No. 850,865, Nov. 14, 1977, Pat. No. 4,180,127.

[51] Int. Cl.[3] ..... B23P 15/26

[52] U.S. Cl. ..... 29/157.3 H; 165/105

[58] Field of Search ..... 165/105; 29/157.3 H, 29/157.3 D, 157.3 R; 174/15 HP

[56] References Cited

U.S. PATENT DOCUMENTS

| | | | |
|---|---|---|---|
| 1,690,108 | 11/1928 | Grady | 165/105 |
| 4,033,130 | 7/1977 | Hermans | 165/105 |

*Primary Examiner*—Francis S. Husar
*Assistant Examiner*—V. K. Rising
*Attorney, Agent, or Firm*—Robert M. Hammes, Jr.

[57] ABSTRACT

A heat pipe heat exchanger has a plurality of heat pipes which are interconnected so as to permit fluid communication between the pipes at least during charging so that the heat pipes may be simultaneously filled with heat transfer fluid.

7 Claims, 9 Drawing Figures

MULTIPLE HEAT PIPE HEAT EXCHANGER AND METHOD FOR MAKING

This is a division of application Ser. No. 850,865, filed 11/14/77 now U.S. Pat. No. 4,180,127.

BACKGROUND OF THE INVENTION

The invention disclosed herein relates to heat exchangers of the type utilizing heat pipes charged with heat transfer fluids. More particularly, the invention concerns such a heat exchanger which is so constructed as to permit simultaneous charging of the heat pipes.

Heat exchangers of this type generally have a plurality of heat pipes arranged in several rows in order to maximize the heat transfer capabilities of the device. In known heat exchangers of this type, the heat pipes are individually evacuated, charged with heat transfer fluid and then sealed. This charging process is both time consuming and expensive due to the individual handling of the heat pipes. Consequently, it is desirable to provide a multiple heat pipe heat exchanger in which the time and expense involved in charging the heat pipes can be drastically reduced.

SUMMARY OF THE INVENTION

According to the invention, a multiple heat pipe heat exchanger is constructed such that the heat pipes are connected together by a conduit means so as to facilitate fluid communication between the plurality of heat pipes. When the heat pipes are thus connected, a suitable heat transfer fluid is introduced into the conduit means and all of the interconnected heat pipes are simultaneously charged with heat transfer fluid. The heat pipes may be arranged in rows with each heat pipe in a row connected to the adjacent heat pipes of that row. In addition, fluid communication between the rows may be accomplished by connecting a heat pipe in one row to a heat pipe in another row. Thus, a continuous path is formed to permit fluid to flow into each heat pipe in each row.

The individual heat pipes and the rows of heat pipes can be selectively isolated from one another after charging by forming a seal in the conduit means between interconnected heat pipes in a row or between the interconnected heat pipes of the connected rows. This seal can be formed without completely severing the conduit means between connected heat pipes, such as by crimping, so that the heat pipes are biased pressure-wise to each other rather than to atmospheric pressure. In such case, the sealing requirements are less severe and the reliablity of the seals can be improved.

By selectively forming a seal in the conduit means separate sets of heat pipes may be formed todfecilitate charging different sets of heat pipes with different heat transfer fluids or to different levels. In such a configuration, the heat pipes of a given heat pipe set are interconnected so as to permit fluid communication between the heat pipes of that set.

According to one method of charging, the interconnected heat pipes are tilted and the effects of gravity are utilized to obtain different levels of heat transfer fluid in the heat pipes of different rows. After charging, and preferably before changing the tilted orientation, a seal is formed in the conduit means between each interconnected row so that the heat pipes of each row are isolated from the heat pipes of every other row.

The invention thus provides a versatile, multiple heat pipe heat exchanger which can be economically charged with heat transfer fluid. Other objects and advantages of the invention will become apparent from the following detailed description taken in conjunction with the drawing figures.

DETAILED DESCRIPTION OF THE PREFERRED EMBODIMENTS

Figure 9:
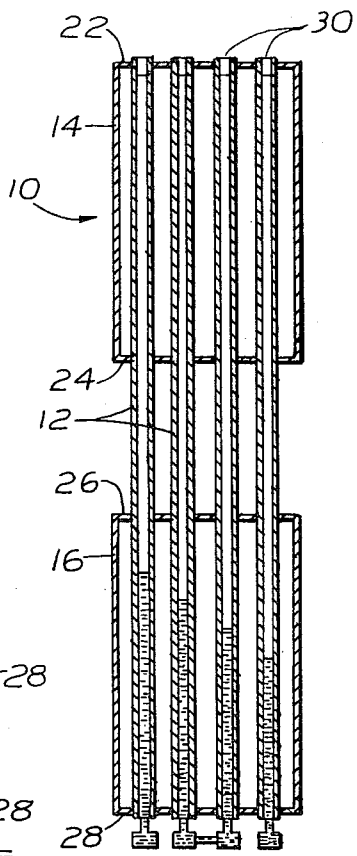
FIG. 9 shows the heat exchanger of FIG. 8 in an upright position after charging.
Figure 8:
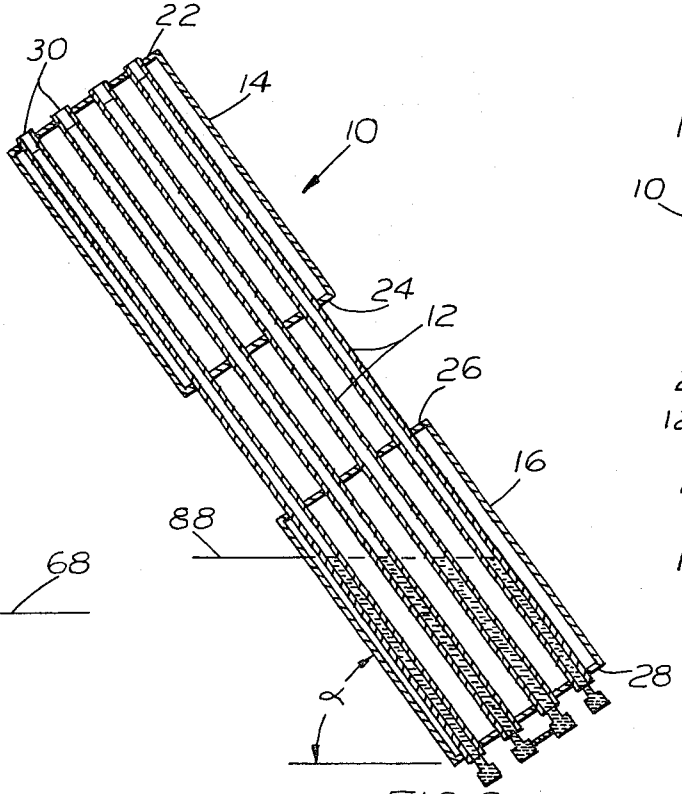
FIG. 8 is a side elevational sectional view taken along line 8—8 in FIG. 2, the heat exchanger being tilted at an angle $\alpha$.
Figure 1:
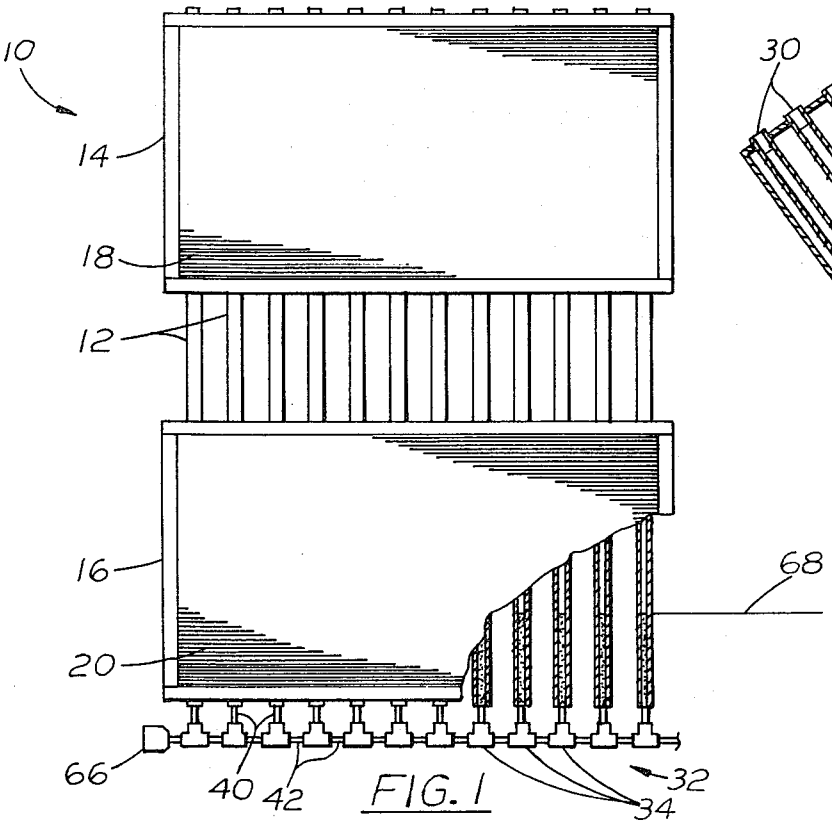
FIG. 1 is an elevational view, partially broken away, of a multiple heat pipe heat exchanger according to the invention.

A multiple heat pipe exchanger, generally indicated at 10, is shown in FIG. 1. Heat exchanger 10 has a plurality of heat pipes 12 which are mounted in upper and lower supporting frames 14, 16. In a typical installation, the upper section may act as a condenser, while the lower section acts as an evaporator. It will be readily apparent that any suitable supporting structure may be provided as an alternative to that shown in FIG. 1. In order to assist the heat transfer process, upper and lower frames 14, 16 typically have finned sections 18, 20, respectively, mounted therein. As best seen in FIGS. 8 and 9, each of heat pipes 12 extend through upper and lower plates 22, 24 of frame 14 as well as through plate 26 and header plate 28 of frame 16. While heat pipes 12 are preferably fixed to plates 22, 24, 26, and 28 in a suitable manner such as by soldering, it is not necessary to attach the heat pipes to the plates. As shown in FIGS. 8 and 9, each of heat pipes 12 is sealed at the top or condensor end, by means of a plug 30 which may be soldered in place. It will be readily apparent that the heat pipes may be sealed in any of a number of ways. For example, the ends could be flattened and soldered to provide a good seal or the pipes may be manufactured with a closed end.

Figure 2:
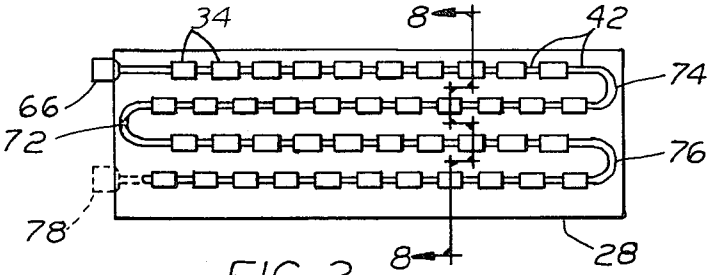
FIG. 2 is a bottom view of the heat exchanger of FIG. 1.

Heat!rmpes 12 may be arranged in any suitable configuration, but are preferably arranged in a plurality of rows as shown in FIGS. 1, 2, 8, and 9. While the embodiment shown has four rows, any appropriate number of rows may be provided. In addition, as best seen in FIG. 2, the heat pipes of one row are preferably offset laterally from the heat pipes in adjacent rows to obtain more efficient heat transfer.

The open ends of heat pipes 12 are connected or looped together by a suitable conduit means, such as header section 32, so as to permit fluid communication among heat pipes 12. Heat pipes 12 may be connected together in any convenient manner as long as there is a continuous path for heat transfer fluid to reach all of heat pipes 12 of heat exchanger 10. In the embodiment shown in FIGS. 1 and 2, each heat pipe in a row is connected to the adjacent heat pipes in that row and a heat pipe in each row is connected to a heat pipe in adjacent rows so that rows are interconnected together. Thus, as seen in FIG. 2, a continuous path is formed to permit fluid communication among all of heat pipes 12. While the interconnection of rows is shown as being accomplished by connecting heat pipes at the ends of adjacent rows, the same result may be obtained by connecting any heat pipe of a given row to any heat pipe of another row.

Figure 3:
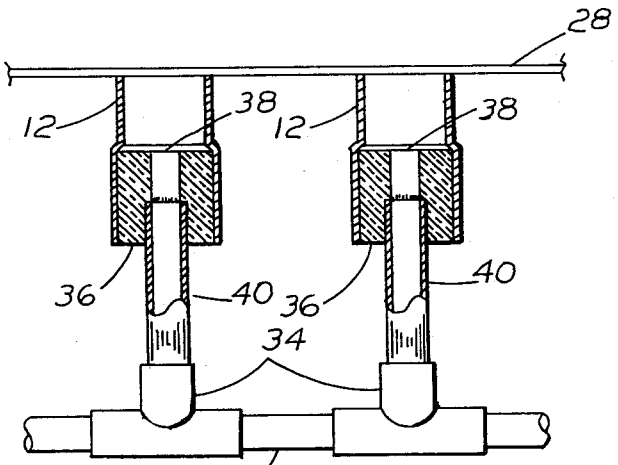
FIG. 3 is a detailed elevational view of a portion of the conduit means of FIG. 1.

The construction of the header section 32 will now be discussed in more detail. In the embodiment shown in FIGS. 1, 2 and 3 header section 32 is comprised of a plurality of tubular tee sections 34, each being associated with a respective one of heat pipes 12. As best seen in FIG. 3, each of heat pipes 12 has a plug 36 inserted in its open end. Each of plugs 36 is provided with an opening in which an end of connecting tube 40 is inserted. The other end of each connecting tube 40 is inserted in a respective tubular tee section 34. Adjacent tee sections 34 are then connected together by connecting tubes 42 as shown. All joints are sealed in an appropriate fashion, as by soldering. Connecting tubes 40, 42, and tee sections 34 may be made of any suitable material such as copper. It will be apparent that connecting tubes 40 may be eliminated if the dimensions of heat pipes 12 and tee sections 34 are chosen so that a direct connection is possible.

Figure 4:
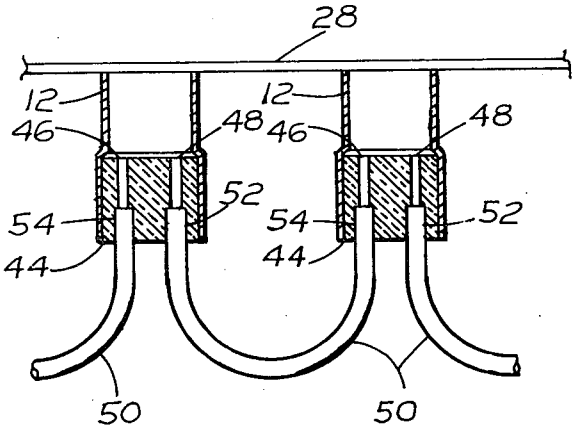
FIG. 4 is a detailed elevational view of a portion of another embodiment of a conduit means.

A second embodiment of header section 32 is shown in FIG. 4. Each of heat pipes 12 are provided with a plug 44 in its open end, each plug 44 having two openings 46, 48 extending therethrough. Heat pipes 12 are then connected together by means of a plurality of looping tubes 50. As shown in FIG. 4, looping tubes 50 are generally U-shaped having ends 52, 54 which are inserted in respective openings 48, 46 of plugs 44 of adjacent heat pipes 12. Looping tubes 50 are secured in place by a suitable means such as by soldering, so as to form an adequate seal to prevent the escape of heat transfer fluid. Since openings 46, 48 extend completely through plugs 44, fluid communication between connected heat pipes may take place.

Figure 6:
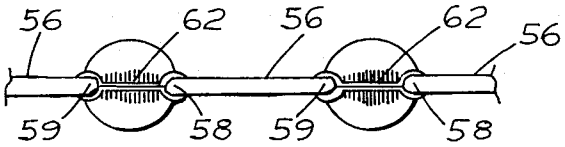
FIG. 6 is a bottom view of the conduit means of FIG. 5.
Figure 5:
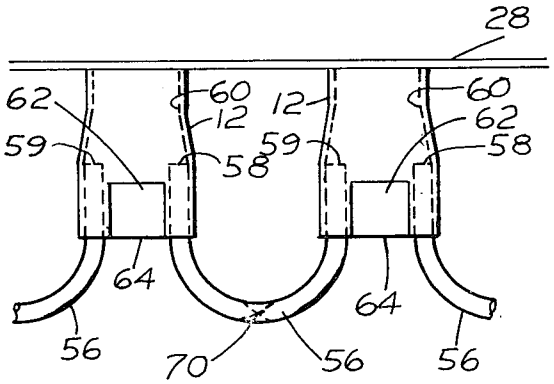
FIG. 5 is a detailed elevational view of a portion of an alternative embodiment of a conduit means.

Another embodiment of header section 32 is shown in FIGS. 5 and 6. In this construction, looping tubes 56, similar in form to looping tubes 50, have ends 58, 59 located adjacent to the inside surface 60 of adjacent heat pipes 12. For any given heat pipe 12, end 58 of one tube 56 and end 59 of another tube 56 are preferably located substantially directly opposite from each other as shown in FIG. 5. The middle section 62 of each heat pipe 12 is then flattened around ends 58, 59 to secure the looping tubes 56 in place. In order to form a satisfactory seal, the crimped ends 64 may be soldered, so as to seal all joints around ends 58, 59.

Attention will now be directed to the method of charging heat pipes 12. Typically, heat pipes are charged by first evacuating the heat pipe, filling the heat pipe with a heat transfer fluid to a desired level, then sealing the end of the heat pipe to prevent escape of the heat transfer fluid. In prior art heat exchangers, this process must be repeated for each individual heat pipe. Since, as shown in FIGS. 1 and 2, heat pipes 12 are connected together by means of header section 32, it is possible to simultaneously charge heat pipes 12 and thus greatly simplify the charging process. In order to facilitate charging, a charging valve 66 is connected in any convenient manner to header section 32. Heat pipes 12 are then simultaneously evacuated, as through charging valve 66 or other passage, by a vacuum means (not shown). After evacuation, heat transfer fluid is introduced through charging valve 66 into header section 32 from which it flows substantially simultaneously into all of heat pipes 12. When a selected amount of heat transfer fluid has been introduced, as indicated by fill line 68, charging valve 66 is turned off to close the passage, whereupon fluid flow ceases. Heat pipes 12 of heat exchanger 10 are thus simultaneously charged to the desired level. It will be readily apparent that charging valve 66 could be located in any of a number of positions. For example, the top end of one of heat pipes 12 may be left unsealed and the charging valve 66 connected thereto so that charging is accomplished through that heat pipe. With respect to the embodiments of header section 32 shown in FIGS. 4, 5 and 6, it is apparent that fluid must flow into one heat pipe before it can flow into the adjacent downstream heat pipe. Thus, there is inherently a certain time lapse between the time fluid flows into the first heat pipes and the time it reaches downstream heat pipes. For the purposes of the invention, this should still be viewed as simultaneous filling since the heat pipes can all be filled in one operation.

Subsequent to charging with heat transfer fluid, it may be desirable to isolate individual heat pipes from one another or to isolate individual rows or sets of rows from one another so as to prevent fluid communication therebetween after charging. Further, it may be advantageous to permit fluid communication between the heat pipes of a row or between rows during the heat transfer process to compensate for variations in the temperature distribution across the exchanger. These various structures may be provided by forming a seal in the conduit means between adjacent heat pipes or between the connected heat pipes of adjacent rows. Referring to FIG. 5, one method of forming such a seal is to crimp looping tube 56 at approximately its mid-section 70, as shown by the dotted lines in FIG. 5. This mechanical crimping forms a seal which will substantially prevent communication of heat transfer fluid between the connected heat pipes 12. Forming a seal between connected heat pipes without severing looping tube 56 provides the advantage of minimum sealing requirements. For example, if the heat transfer fluid is Freon 22, the pressure at a room temperature of 74° F. is approximately 130 psi with respect to atmospheric pressure. If the heat pipes are individually sealed, the seal must be able to withstand this 130 psi condition. By forming the seal such that the looping tubes are not severed, the differential sealing requirement is zero, assuming the heat pipes are at the same temperature. This advantage reduces the cost of sealing and improves the reliability of the device.

Figure 7:
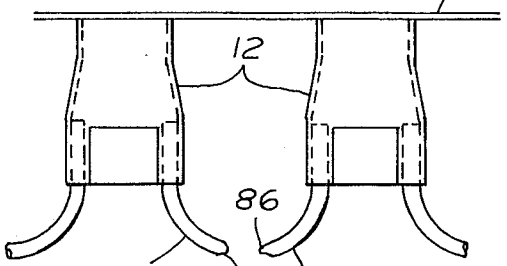
FIG. 7 is a detailed elevational view in which the conduit means is crimped off between adjacent heat pipes.

In certain situations, it may be desirable to have the connection between adjacent heat pipes or adjacent rows completely severed after charging. This may be desirable if it is anticipated that individual recharging of heat pipes 12 may be desired at some future time. This may be accomplished in any suitable manner such as by crimping off the looping tube 56 of FIG. 5 so as to form two separate segments 80, 82, as shown in FIG. 7. The ends 84, 86 of segments 80, 82, respectively, must then be completely sealed to prevent the escape of heat transfer fluid therefrom. Sealing may be accomplished by soldering or other suitable means.

In certain applications it may be desirable to provide a heat exchanger with various rows of heat pipes charged with different heat transfer fluid or to different levels. For example, in a heat exchanger where it is desirable to have a high degree of heat transfer capability, a front set of rows of heat pipes may be charged with water and a back set of rows of heat pipes may be charged with Freon. The utilization of multiple heat transfer fluids allows for the maximization of the heat transfer capability of the heat exchanger. This type of charging may be easily accomplished by forming a seal in the conduit means between connected heat pipes of adjacent rows as shown, for example, in dashed lines at 72 in FIG. 2. Thus, a front set 74 of heat pipe rows and a rear set 76 of heat pipe rows are formed. By appropriate selection of the location of the seal the number of rows in a given set can be varied to meet the conditions of a particular application. By providing a second charging valve 78 associated with the rear set 76 of heat pipe rows, each set can be charged to the desired level with separate heat transfer fluids. Additional row sets can be provided by forming additional seals in the conduit means. It is thus apparent that a large degree of flexibility in the making of heat exchangers is provided.

It is also possible, according to the invention, to simultaneously charge each individual row of heat pipes to different levels. Referring to FIGS. 8 and 9, by tilting heat exchanger 10 to a desired angle $\alpha$ in the manner shown in FIG. 8, heat transfer fluid can be introduced into heat pipes 12 to a desired fill line 88. After charging, a seal is formed in the conduit means between the connected heat pipes of each adjacent row so that the rows of heat pipes are isolated from one another. This results in each row of heat pipes being charged to a different level as shown in FIG. 9.

It will be apparent that many modifications or alternate constructions may be employed without departing from the scope and spirit of the invention. Consequently, the embodiments shown and described herein are exemplary only and the invention is limited solely by the claims.

I claim:

1. A method for making a heat exchanger comprising the steps of: Providing a plurality of heat pipes, each of said heat pipes having a closed top end and an open bottom end; interconnecting the open ends of said heat pipes with conduit means to permit fluid communication between said heat pipes; and substantially simultaneously charging each of said heat pipes by introducing a selected amount of transfer fluid into said heat pipes through a passage in fluid communication with said conduit means; and sealing said passage.

2. A method as in claim 1 additionally comprising the step of isolating one heat pipe from another heat pipe by forming a seal in said conduit means between said one and said another heat pipes after said charging step.

3. A method according to claim 2 additionally comprising the steps of tilting the connected heat pipes prior to charging so that at least a first heat pipe is charged to a different level than a second heat pipe, and forming said seal so as to maintain different charge levels in said first and second heat pipes.

4. A method according to claim 2 wherein said seal forming step provides a plurality of sets of heat pipes, each of said sets comprising a plurality of heat pipes interconnected for fluid communication, said one heat pipe being an element of one heat pipe set and said another heat pipe being an element of another heat pipe set, wherein said charging step comprises introducing each of a plurality of heat transfer fluids into a respective one of said sets.

5. A method as in claim 1 additionally comprising the step of arranging said heat pipes adjacently substantially in parallel with proximate open ends prior to said interconnecting step.

6. A method as in claim 5 wherein said interconnecting step comprises providing a plurality of looping tubes, inserting one end of each looping tube in the open end of one heat pipe, inserting the other end of each looping tube in the open end of another heat pipe, locating ends of at least two looping tubes adjacent an inside surface of one of said heat pipes, and crimping the open end of said heat pipe around said looping tube ends.

7. A method as in claim 2 wherein said seal forming step comprises crimping off said conduit means.

* * * * *